US009309693B2

(12) United States Patent
Puscas et al.

(10) Patent No.: US 9,309,693 B2
(45) Date of Patent: Apr. 12, 2016

(54) STRIKER COVER FOR A VEHICLE

(71) Applicant: FORD GLOBAL TECHNOLOGIES, LLC, Dearborn, MI (US)

(72) Inventors: Livianu Dorin Puscas, Rochester Hills, MI (US); Bhupendra A. Patel, Canton, MI (US); Kosta Papanikolaou, Huntington Woods, MI (US); David Manuel Rogers, Southfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 229 days.

(21) Appl. No.: 14/182,676

(22) Filed: Feb. 18, 2014

(65) Prior Publication Data

US 2015/0233144 A1 Aug. 20, 2015

(51) Int. Cl.

*E05B 15/02* (2006.01)
*E05B 85/00* (2014.01)
*E05B 85/04* (2014.01)

(52) U.S. Cl.

CPC ..... *E05B 15/029* (2013.01); *E05B 85/00* (2013.01); *E05B 85/045* (2013.01); *Y10T 292/694* (2015.04)

(58) Field of Classification Search

CPC ..... E05B 83/18; E05B 85/04; E05B 85/045; E05B 85/00; E05B 15/029; Y10T 292/694
USPC ..... 292/340, 341.14, 341.15, 341.16, 292/DIG. 43; 70/2, 54–56, DIG. 43, DIG. 56
See application file for complete search history.

(56) References Cited

U.S. PATENT DOCUMENTS

| | | | | |
|---|---|---|---|---|
| 6,364,380 | B2 * | 4/2002 | Franz | E05B 15/029 292/219 |
| 7,758,097 | B2 * | 7/2010 | Dilley | B60R 13/013 296/193.11 |
| 8,246,088 | B2 * | 8/2012 | Stechschulte | E05B 77/00 292/1 |
| 8,469,440 | B2 * | 6/2013 | Thorpe | E05B 77/36 292/341.15 |
| 8,616,612 | B2 * | 12/2013 | Quinn | E05B 77/38 292/340 |
| 8,998,278 | B2 * | 4/2015 | Wilde | E05B 79/20 292/144 |
| 2013/0038075 | A1 | 2/2013 | Wilde et al. | |
| 2014/0265377 | A1 * | 9/2014 | Gardner | E05B 85/045 292/341.14 |

FOREIGN PATENT DOCUMENTS

| | | | | |
|---|---|---|---|---|
| DE | EP 0894919 | A1 * | 2/1999 | E05B 15/029 |
| DE | 10007420 | A1 * | 8/2001 | E05B 15/029 |
| DE | 102011053331 | A1 * | 3/2013 | E05B 77/42 |
| FR | DE 102006044953 | A1 * | 4/2007 | E05B 15/029 |
| JP | 2004044258 | A * | 2/2004 | |
| JP | 2007217908 | A * | 8/2007 | |
| KR | 20030082804 | A * | 10/2003 | |
| KR | 20080039665 | A | 5/2008 | |
| WO | WO 2004060720 | A2 * | 7/2004 | E05B 15/029 |

* cited by examiner

*Primary Examiner* — Kristina Fulton
*Assistant Examiner* — Christine M Mills
(74) *Attorney, Agent, or Firm* — Raymond Coppiellie; Brooks Kushman P.C.

(57) ABSTRACT

Striker cover for use with a vehicle closure. The striker cover having two cover pieces with coaxial pivot edges, that when contacted by a latch, pivot into a cam and separate to provide access of the latch to the striker. When the vehicle closure is open, springs bias the cover pieces toward each other and into the cam, rotating the cover pieces back into a first position. In the first position the cover pieces cover the striker and obstruct the striker from view.

17 Claims, 3 Drawing Sheets

STRIKER COVER FOR A VEHICLE

TECHNICAL FIELD

This disclosure relates to vehicle closures having a latch and striker combination to secure a closure panel to a vehicle when the latch engages the striker, and specifically to the covering of the striker when the closure panel is open.

BACKGROUND

A vehicle closure may be opened to provide access to an area of the vehicle or closed to secure it. A vehicle closure may be a door, decklid, hood, or top, among other things. A vehicle door is typically a type of closure that is in front of an opening which is used for entering and exiting a vehicle. A vehicle door may be hinged or attached by other mechanisms such as tracks, such as often used to access cargo areas of vans. A rear door on a vehicle may also be referred to as a hatch or tailgate. Traditionally the hatch is a rear door that swings upward to provide access to a cargo area, and the vehicle this door is on is referred to as a hatchback. A tailgate is a rear door that is hinged at the bottom and is common on station wagons, pickup trucks, and sport utility vehicles.

A decklid, also known as a trunk lid or boot lid, is the closure that allows access to the main storage or luggage compartment. A hood, which may also be referred to as a bonnet, is a closure that allows access to an engine (or prime mover) compartment. A top is a form of vehicle closure that may open the cockpit of a vehicle to the open-air, and the kinds of vehicles that have a top are generally referred to as convertibles.

Most vehicle closures require a means for securing the closure to the vehicle when the closure is in a closed position. A latch and striker combination may be used with a vehicle closure to releasably engage the latch on to the striker to secure the closure. Typically the latch is located on the closure and the striker is located on the vehicle proximate to the opening the closure encloses when closed. The striker typically extends away from the vehicle to which it is attached allowing the latch to engage and at least partially wrap around a portion of the striker.

Although a striker may be partially disposed in a void, when a closure is opened the striker is visible. A visible striker may be undesirable from a fit and finish concern. An outwardly extending striker may provide a snag point on clothing or parcels moving through the closure opening. The striker may also have grease or other debris that may transfer to articles as they pass though the closure opening.

SUMMARY

One aspect of this disclosure is directed to a cover assembly for a striker on a vehicle. In this aspect, an axle is disposed adjacent a striker, and a cover is assembled to the axle such that it may pivot on the axle. The cover has a first position covering the striker and a second position that provides access to the striker. The cover has a first piece abutting a second piece in the first position. The assembly has a cam which is engaged by the cover as the cover pivots about the axle to a second position. The cam separates the first piece from the second piece and provides access to the striker.

The assembly may include a spring to bias the cover toward the first position. The assembly may include a first spring and a second spring, each disposed along the axle biasing the first and second pieces toward each other. The first and second springs bias the first and second pieces towards each other and into contact with the cam, and when the cover is not in the first position, the engagement with the cam rotates the cover back toward the first position as the first and second piece are biased to move closer together.

The cam may be substantially triangular in shape with two equal distance sides. The cover may contact the sided of the cam as the cover pivots away from the first position, and the sides of the cam separate the first and second pieces from each other as they pivot down the sides of the triangular cam. The striker may include a base in which the cam is connect to and extends from. The first and the second pieces may be fully disposed on opposite sides of the base in the second position.

The vehicle may include a closure panel having a latch assembly. The latch assembly may contact and pivot the cover from the first position to the second position as the closure panel closes. The vehicle may also define a void with the striker disposed in the void. In this case, the cover in the first position cooperates with the void to obscure the striker from view.

According to another aspect of this disclosure, a vehicle closure system is described. The vehicle closure system has a latch disposed on a closure panel and a striker attached to the vehicle engagable by the latch for releasably securing the closure panel. In this aspect, adjacent cover pieces cover the striker when the closure panel is open. In this system the latch pushes the adjacent cover pieces into a cam to provide access for the latch to engage the striker when the closure panel closes. The cam separates the adjacent cover pieces.

The closure panel may be a decklid that provides access to a trunk. The vehicle may define a void in which the striker is disposed therein. The adjacent cover pieces may cooperate with the void to obscure view of the striker when the closure panel is in an open position. A portion of the void may be defined by a trim piece.

The adjacent cover pieces may pivot on a common axis. The system may have first and second springs bias the adjacent cover pieces toward each other. The springs may also be on the common axis. The cam may be substantially triangular in shape having two sides and the first and second springs may bias the adjacent cover pieces towards each other and into contact with the cam. The cam may then rotate the adjacent cover pieces toward a covering position as the adjacent cover pieces move closer together. An axle may provide the common axis. The axle may be disposed proximate the striker and the adjacent cover pieces may pivot about the axle. The striker may have a base plate defining an axle aperture and a portion of the axle may be disposed therein.

According to a further aspect of this disclosure, a cover for a striker is shown. In this aspect, a first cover piece and a second cover piece, each having coaxial pivot edges and abutting mating edges when the cover pieces are in a first position. The cover pieces simultaneously pivot about the pivot edges and the mating edges separate to provide access to the striker in a second position.

The striker may be attached to a vehicle that has a closure panel with a latch that engages the striker to secure the closure panel to the vehicle. In this case, a cam may be disposed between the striker and the cover pieces. The latch pivots the cover pieces into contact with the cam separating the cover pieces about the striker as the closure panel closes.

The above aspects of this disclosure and other aspects will be explained in greater detail below with reference to the attached drawings.

DETAILED DESCRIPTION

Figure 1:
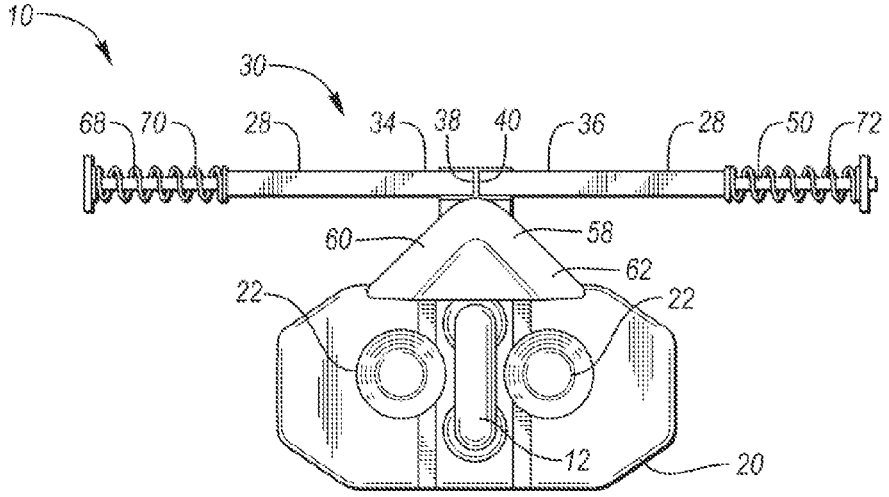
FIG. 1 is a top view of a striker cover assembly having a cover in a covering position.

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

FIGS. 1-5 show an example of a cover assembly 10 for a striker 12 in varying views and configurations. The striker 12 may be a free standing component or may be part of the cover assembly 10. Striker 12 is configured to cooperate with a latch assembly 14, more simply referred to as a latch 14, to releasably secure a closure panel 16, more simply referred to as a closure 16, to a vehicle 18 (see FIGS. 6 and 7). Although the striker 12 is shown attached to the vehicle 18 with the latch 14 attached to the closure 16, it is to be understood that the components may be swapped such that the striker 12 is attached to the closure 16 and the latch 14 is attached to the vehicle 18.

The striker 12 may extend from a base plate 20, more simply referred to as base 20, with the base 20 providing attachment locations 22 to attach the striker to the vehicle 18. The attachment locations 22 may be apertures defined by the base 20 that in combination with a bolt (not shown), or other known form of attachment, allow for the striker 12 to be fixedly attached to the vehicle 18.

Figure 3:
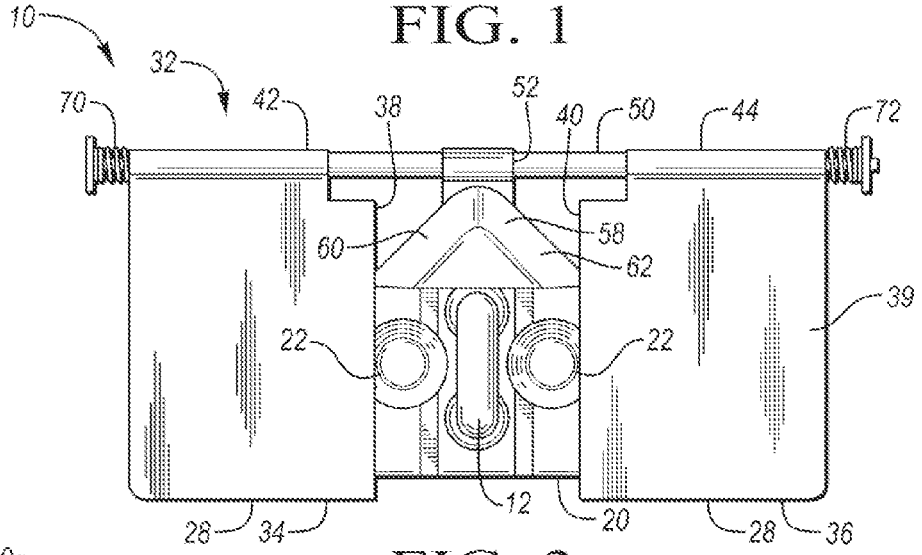
FIG. 3 is a top view of a striker cover assembly having a cover in a striker access position.
Figure 2:
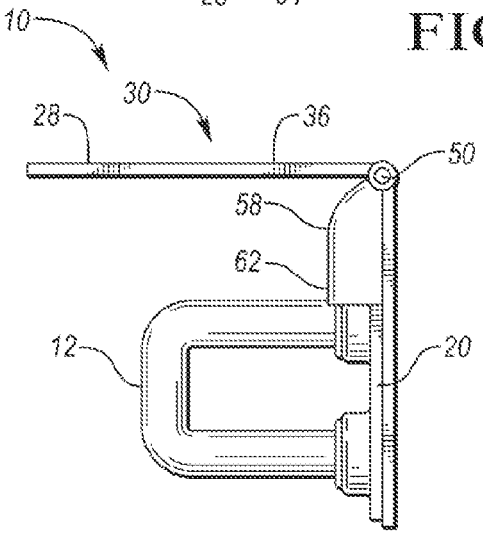
FIG. 2 is a side view of a striker cover assembly having a cover in a covering position.
Figure 4:
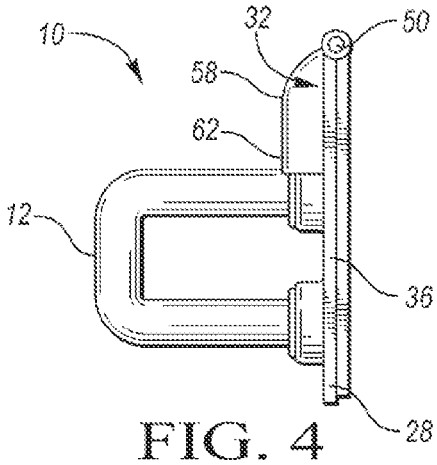
FIG. 4 is a side view of a striker cover assembly having a cover in a striker access position.
Figure 5:
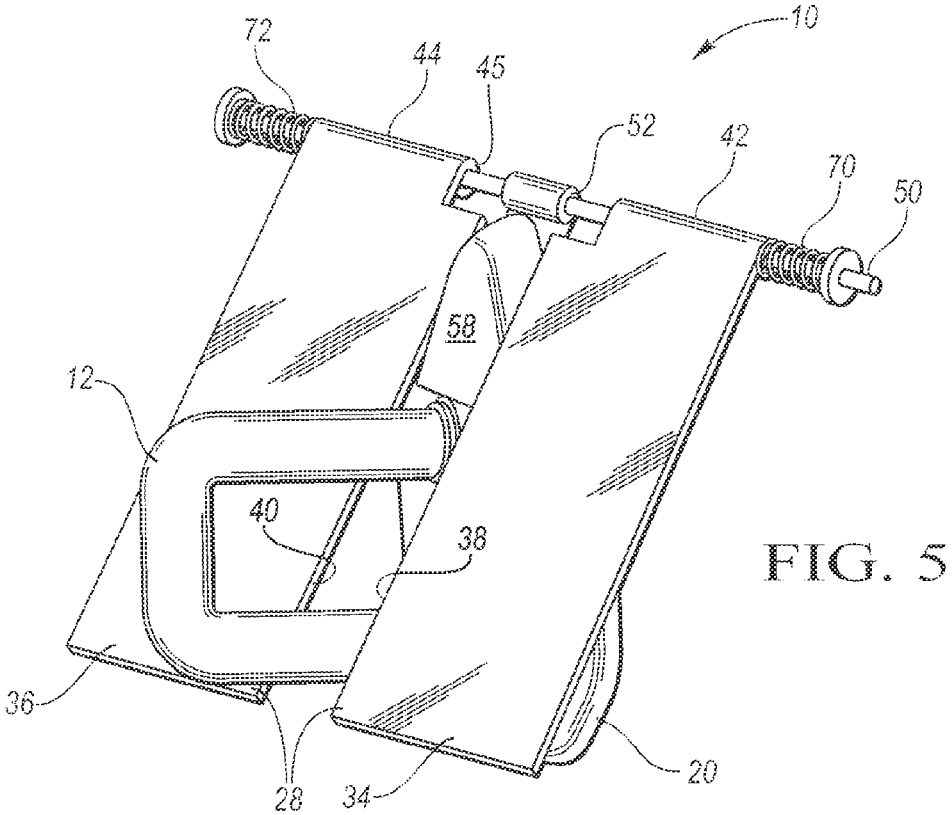
FIG. 5 is a perspective view of a striker cover assembly in transition from a covering position to a full access position.

The cover assembly 10 has a cover 28 configured to enclose the striker 12 in a first position 30 (FIGS. 1 and 2) and provide access for the latch 14 to engage the striker 12 in a second position 32 (FIGS. 3 and 4). The cover 28 has a first cover piece 34, or more simply referred to as a first piece 34, and a second cover piece 36, or more simply referred to as a second piece 36. The first and second pieces 34, 36 may also be referred to as cover pieces 34, 36.

The cover pieces 34, 36 may be adjacent each other, with the first piece 34 abutting the second piece 36 in the first position 30 covering the striker 12. The cover pieces 34, 36 may each have a respective mating edge 38, 40 that are abutting when the cover pieces 34, 36 are in the first position 30. Each cover piece may also include a major side 39. The cover pieces 34, 36 may separate from each other to provide access to the striker 12 in a second position 32. The cover pieces 34, 36 may separate from each other such that the first and the second pieces 34, 36 are disposed on opposite sides of the base 20 in the second position 32.

The cover pieces 34, 36 may each have respective coaxial pivot edges 42, 44. The pivot edges 42, 44 may define a journal 45 that receives the shaft therethrough. The cover pieces 34, 36 may simultaneously pivot about the pivot edges 42, 44 and separate to provide access to the striker 12 in a second position 32. The pivot edges 42, 44 of the cover pieces 34, 36 may pivot on a common axis provided by an axle 50. The cover 28 may be assembled to pivot on the axle 50 and the axle 50 may be disposed proximate to or adjacent the striker 12. The base 20 may define an axle aperture 52 with a portion of the axle 50 disposed therein.

The cover assembly 10 has a cam 58. The cam 58 may be disposed between the striker 12 and the cover pieces 34, 36. The cam 58 may extend from the base 20. The cam 58 is configured to be engaged by the cover 28 as the cover 28 pivots about the axle 50 toward the second position 32. As the cover 28 pivots toward the second position 32, the cam 58 separates the first piece 34 from the second piece 36 to provide access to the striker 12.

The cam 58 may be substantially triangular in shape having two sides 60, 62, respectively. Substantially, as used here, means that the cam 58 need not be a perfect triangle, that the sides 60, 62 may be curved or include additional angles, and the sides 60, 62 may not meet at a perfect pointed apex. Substantially triangular in shape indicates that the two sides 60, 62 are generally closer to each other nearer the cover 28 in the first position 30 and generally taper away from each other as the sides get further away from the cover 28 in the first position 30. As such, the cover pieces 34, 36 contact the cam 58 as the cover 28 pivots away from the first position 30, the first and second pieces 34, 36 separating from each other as they continue to pivot and engage the sides of the triangular cam 58.

The cover assembly 10 may have at least one spring 68 biasing the cover 28 toward the first position 30. The at least one spring 68 may be a first spring 70 and a second spring 72 disposed along the axle 50 biasing the first and second pieces 34, 36 toward each other. The first spring 70 contacts the first piece 34 along the axle 50 opposite of the second piece 36, the second spring 72 contacts the second piece 36 along the axle 50 opposite the first piece 34, biasing the cover pieces 34, 36 toward each other along the axle 50. Thus, when the cover 28 is in the first position 30, the springs 70, 72 bias the mating edges 38, 40 together.

When the cover 28 is not in the first position, the springs 70, 72 bias the cover pieces 34, 36 towards each other and into the cam 58 disposed therebetween. The springs 70, 72 bias the cover pieces 34, 36 into the cam 58 rotating the cover pieces 34, 36 back toward the first position 30. The cam 58 maintains the separation of the cover pieces 34, 36 when the cover 28 is not in the first position 30. The cam 58 being substantially triangular in shape having two sides 60, 62 and the first and second springs 70, 72 biasing the cover pieces 34, 36 towards each other and into contact with the cam 58 rotates the cover pieces 34, 36 toward the first position 30 as the cover pieces 34, 36 move closer together.

Figure 6:
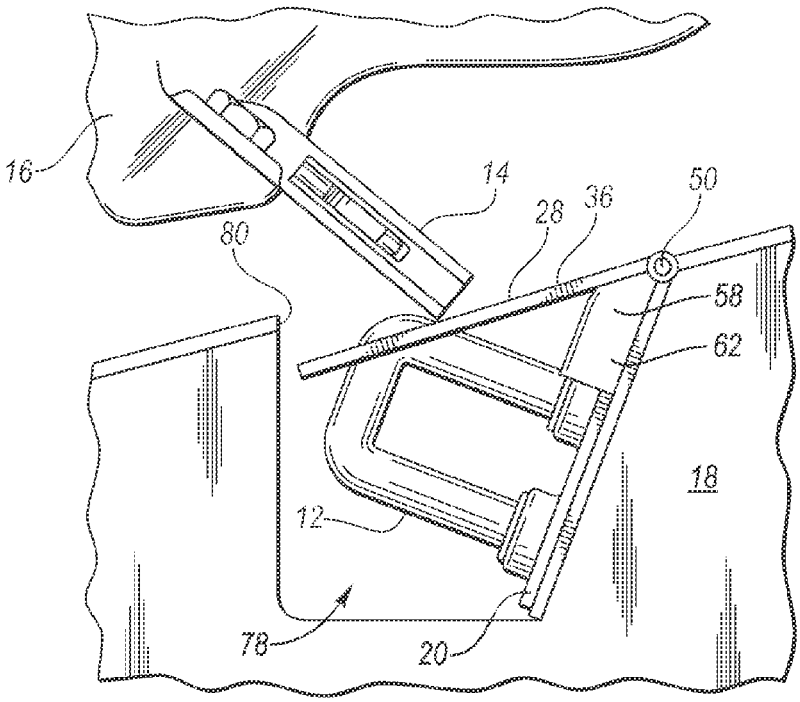
FIG. 6 is a side view of a striker disposed in a void of a vehicle, a closure panel having a latch, and the latch contacting a cover pivoting the cover from a covering position toward an access position where the latch may engage the striker and secure the closure panel to the vehicle.

FIG. 6 shows a vehicle 18 defining a void 78 with at least a portion of the striker 12 disposed within the void 78. A portion of the void 78 may be defined by a trim piece 80, such as a scuff plate. The latch 14 is shown connected to a closure 16, and the closure 16 is closing on the vehicle 18. The latch 14 may contact the cover 28 to move the cover 28 from the first position 30 to the second position 32. In this figure, the latch 14 is contacting and pivoting the cover 28 from the first position 30 to the second position 32 as the closure 16 is closing. The latch 14 pivots the cover 28 into contact with the cam 58 separating the cover pieces 34, 36 about the striker 12 to provide access for the latch 14 to contact and engage the striker 12. The separation of the cover pieces 34, 36 allows the latch 14 to engage the striker 12 and secure the closure 16 to the vehicle 18.

Figure 7:
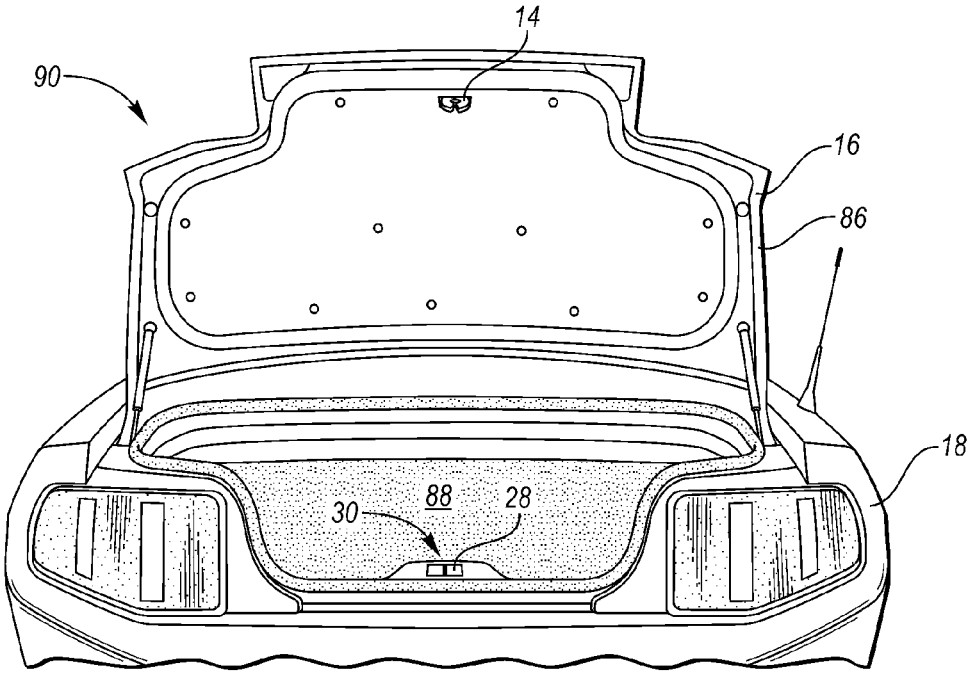
FIG. 7 is a partial rear view of a vehicle showing a decklid in an open position and a cover in a covering position.

FIG. 7 shows a partial rear view of a vehicle in which the closure 16 is a decklid 86 in an open position providing access to a trunk 88. The latch 14 may be seen attached to the decklid 86, but the striker 12 is covered by the cover 28. The cover 28, being in the first position 30 when the decklid 86 is open, obscures the striker 12 from view providing for an improved fit and finish. As well, the striker 12 is further covered and may reduce a potential snag point on clothing or parcels moving through the closure opening. As well, the potential transfer of any debris that may be on the striker 12 to articles as they pass though the closure opening may also be reduced. When the cover 28 is used in conjunction with a vehicle closure 16 to cover and uncover the striker 12, a vehicle closure system 90 is provided.

Figure 8:
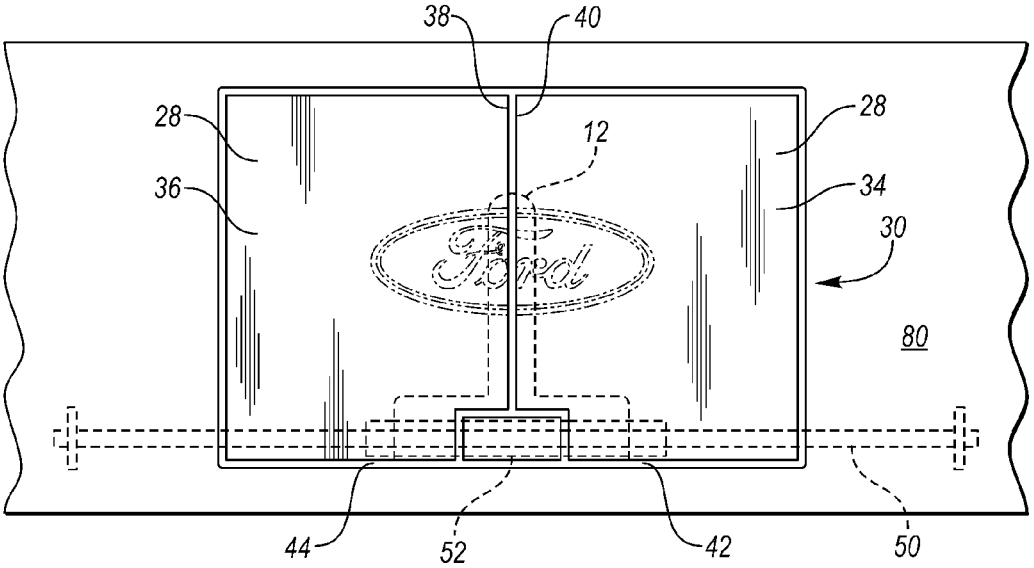
FIG. 8 is partial view of cover cooperating with a trim piece to obscure the view of a striker.

FIG. 8 shows a cover 28 in a first position 30 cooperating with a trim piece 80 to obscure view of the striker 12. The cover 28 may include indicia, such as the make or model of vehicle. The cover 28 may also be made of an opaque material and a light (not shown) disposed below the cover 28 to illuminate the cover for increased fit and finish appearance and to aid in a user knowing where a boundary of the closure opening.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A cover assembly for a striker on a vehicle comprising:
an axle disposed adjacent a striker on a vehicle;
a cover including first and second cover halves assembled to pivot and axially slide on the axle, each of the first and second cover halves having a major side and a mating edge that is substantially perpendicular to the major side, wherein a pair of springs disposed on the axle bias the mating edges to be in contact with each other when the cover is in a first position covering the striker with the major sides; and
a cam including first and second sides that each engage one of the first and second cover halves as the cover pivots about the axle to a second position to slide the first and second cover halves in opposite directions along the axle separating the mating edge of the first cover half from the mating edge of the second cover half to provide access to the striker.

2. The assembly of claim 1 wherein each of the first and second cover halves receive the axle therethrough.

3. The assembly of claim 1 wherein, in the second position, the pair of springs bias the first and second cover halves towards each other and into contact with the cam, the cam urging the cover to rotate back toward the first position as the first and second cover halves move closer together.

4. The assembly of claim 1 wherein the cam is substantially triangular in shape having an apex nearest to the axle, wherein the first and second sides are joined at the apex.

5. The assembly of claim 1 wherein the striker has a base and the first and the second cover halves are disposed on opposite sides of the base in the second position.

6. The assembly of claim 5 wherein the first and second cover halves are a same size.

7. The assembly of claim 1 wherein the vehicle includes a closure having a latch and the latch contacts and pivots the cover from the first position to the second position as the closure closes.

8. The assembly of claim 1 wherein the vehicle defines a void and the striker is disposed in the void, and the cover in the first position cooperates with the void to obscure the striker from view.

9. A vehicle closure system comprising:
a latch disposed on a closure;
a striker engagable with the latch;
adjacent covers having coaxial pivot edges disposed on a same axle, and covering the striker when the closure is open; and
a cam sliding the covers in opposite directions along the axle to separate the covers as the latch pushes the covers into the cam providing access for the latch and striker to engage when the closure closes.

10. The system of claim 9 wherein the adjacent covers are a same size.

11. The system of claim 9 further comprising a first spring and a second spring disposed on the axle such that the covers are sandwiched between the first spring and the second spring, wherein the first spring and the second spring cooperate to bias the adjacent covers toward each other.

12. The system of claim 11 wherein the cam is substantially triangular in shape having two sides and the first and second springs bias the adjacent covers towards each other and into engagement with the cam, the cam rotating the adjacent covers toward a covering position as the adjacent covers move closer together.

13. The system of claim 9 wherein the striker has a base defining an axle aperture and a portion of the axle is disposed therein.

14. A striker assembly comprising:
an axle;
a striker;
first and second covers each defining a journal disposed around the axle, and mating edges that are abutting to cover the striker when in a first position; and
a cam engaging the first and second covers to slide the covers in opposite directions along the axle to separate the mating edges as the first and second covers rotate about the axle to a second position providing access to the striker.

15. The cover of claim 14 wherein the first and second covers are a same size.

16. The cover of claim 14 wherein the cam further includes first and second sides joined at an apex, wherein the first side engages the first cover and the second side engages the second cover to wedge the first and second covers apart as the first and second covers rotate to the second position.

17. The cover of claim 14 wherein each of the first and second covers further includes a major side that is substantially perpendicular to the mating edge, wherein the major sides of the first and second covers cooperate to cover the striker when the first and second covers are in the first position.

* * * * *